United States Patent [19]

Stewart et al.

[11] 4,333,909

[45] Jun. 8, 1982

[54] FLUIDIZED BED BOILER UTILIZING PRECALCINATION OF ACCEPTORS

[75] Inventors: Robert D. Stewart, Verona; Robert L. Gamble, Wayne, both of N.J.

[73] Assignee: Foster Wheeler Energy Corporation, Livingston, N.J.

[21] Appl. No.: 148,339

[22] Filed: May 9, 1980

[51] Int. Cl.[3] ..... F27B 15/08; F27B 15/10; F27B 15/14; B01J 8/28

[52] U.S. Cl. ..... 422/141; 110/345; 110/347; 422/143; 422/145; 422/146; 423/244; 431/7; 431/170; 432/15; 432/58

[58] Field of Search ..... 422/109, 111, 119, 141, 422/142, 143, 145, 146, 144; 110/345, 347; 122/4 D; 34/57 A; 201/31; 431/7, 170; 423/244 A; 432/15, 58

[56] References Cited

U.S. PATENT DOCUMENTS

| | | | |
|---|---|---|---|
| 2,584,312 | 2/1952 | White . | |
| 2,586,818 | 2/1952 | Harms | 422/145 X |
| 2,673,081 | 3/1954 | Fay et al. . | |
| 3,236,607 | 2/1966 | Porter et al. | 422/141 |
| 3,995,987 | 12/1976 | MacAskill . | |
| 3,998,929 | 12/1976 | Leyshon | 422/143 X |
| 4,059,393 | 11/1977 | Kobayashi . | |
| 4,096,642 | 6/1978 | Triebel . | |
| 4,135,885 | 1/1979 | Wormser | 422/142 |
| 4,303,023 | 12/1981 | Perkins et al. | 422/142 X |

*Primary Examiner*—Barry S. Richman

*Attorney, Agent, or Firm*—Marvin A. Naigur; John E. Wilson; Warren B. Kice

[57] ABSTRACT

A fluidized bed boiler, and a method of operating same in which air is passed through a grate to fluidize a bed of particulate material containing fossil fuel disposed on the grate. A raw acceptor for the sulfur produced as a result of the combustion of the fuel is introduced into the housing and confined within an area of the housing isolated from the bed of particulate material. The area containing the acceptor is maintained at conditions optimal for calcining the acceptor, after which the latter is introduced into the fluidized bed.

15 Claims, 3 Drawing Figures

FLUIDIZED BED BOILER UTILIZING PRECALCINATION OF ACCEPTORS

BACKGROUND OF THE INVENTION

The present invention relates to a fluidized bed boiler and a method of operating same, and more particularly to such a boiler and method in which an acceptor is introduced into the fluidized bed for capturing the sulfur generated during the combustion process.

Fluidized bed reactors or boilers have long been recognized as an attractive and effective means of generating heat when used as a gasifier, combustor, or the like. In these arrangements air is passed through a bed of particulate material which normally consists of a mixture of inert material, a particulate fossil fuel, such as bituminous coal, and an acceptor, such as limestone, used for the capture of sulfur generated during the gasification or combustion of the fossil fuel. The air fluidizes the bed and promotes the combustion of the fuel resulting in a combination of high heat release, improved heat transfer to surfaces within the bed and compact reactor or combustor size.

In these types of arrangements, it is highly advantageous to use a calcined limestone, normally referred to as "lime", since, if calcined, the lime is 30% to 50% more effective in capturing the sulfur from the combusted fossil fuel when compared to raw limestone that has not been calcined.

Although it is possible to calcine the limestone directly within the fluidized bed, the reaction is usually completed less efficiently due to the temperatures and conditions that must be maintained within the bed which results in reduced reactivity for most limestone acceptors. In addition, breaking up of the limestone particles into very fine particles occurs on shock heating, with these fine particles being carried away from the bed with the mixture of air and gaseous products of combustion. These effects, of course, also reduce the effectiveness of the acceptors.

According to some prior art techniques, the raw limestone can be calcined externally of the fluidized bed, or purchased in a calcined form, before it is introduced into the bed. However, since calcined limestone costs approximately eight to ten times more than raw uncalcined limestone, it can be appreciated that this can considerably add to the cost of the process.

SUMMARY OF THE INVENTION

It is therefore an object of the present invention to provide a fluidized bed boiler and a method of operating same in which the additional cost of precalcined limestone is avoided.

It is a further object of the present invention to provide a fluidized bed boiler and method of the above type in which raw limestone is calcined utilizing the heat of the fluidized bed boiler yet is not broken up into fine particles by rapid thermal shock.

It is still a further object of the present invention to provide a fluidized bed boiler and method of the above type in which raw limestone is introduced into the boiler and is calcined in an area isolated from the bed before being introduced into the bed in a calcined form.

Toward the fulfillment of these and other objects, a grate is supported in a housing and is adapted to receive a bed of particulate material at least a portion of which is fossil fuel. Air is passed through the grate and the particulate material to fluidize the particulate material.

An acceptor for the sulfur produced as a result of the combustion of the fuel is introduced into the housing and maintained in a confined area of the housing that is isolated from the bed of particulate material. This confined area is maintained at calcining conditions to calcine the acceptor after which it is introduced into the bed for accepting the sulfur generated by the fossil fuel in the combustion process.

DESCRIPTION OF THE PREFERRED EMBODIMENT

Figure 1:
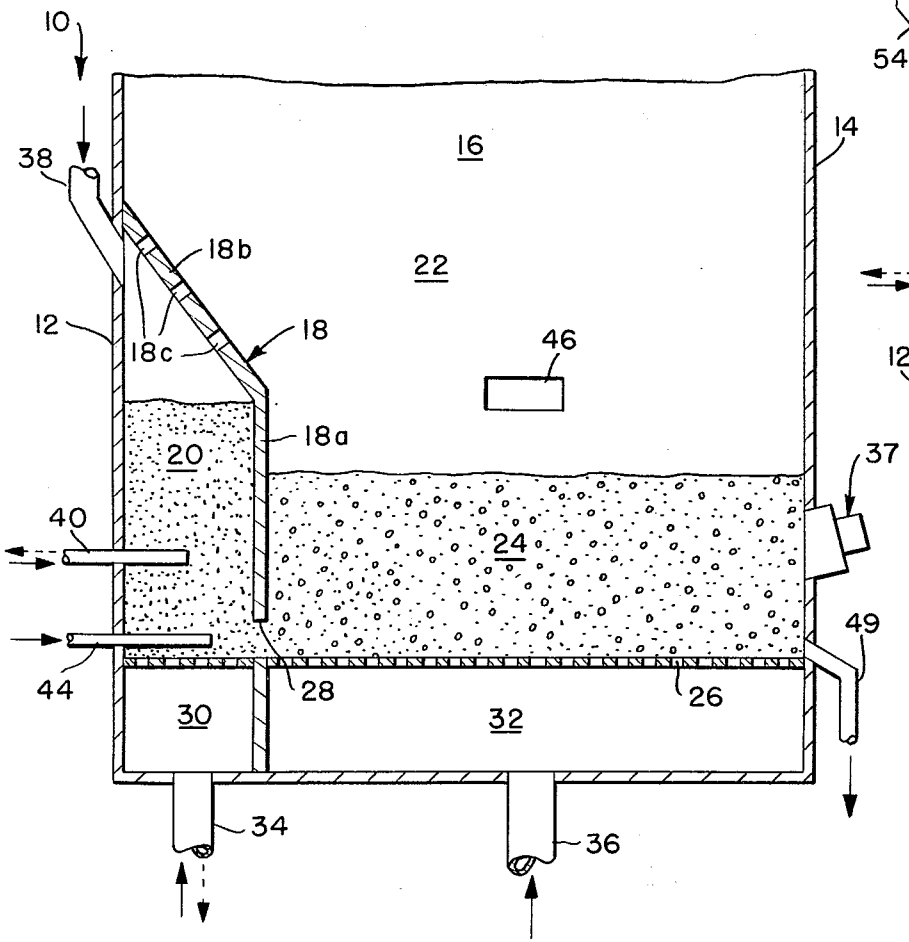

Referring specifically to FIG. 1 of the drawings, the reference numeral 10 refers in general to a portion of a fluidized bed boiler of the present invention which comprises a front wall 12, a rear wall 14 and two side walls, one of which is shown by the reference numeral 16. The upper portion of the boiler is not shown for the convenience of presentation, it being understood that it consists of a convection section, a roof and an outlet for allowing the combustion gases to discharge from the boiler, in a conventional manner.

A partition 18 is disposed within the boiler and has a vertical portion **18*a* which extends in a parallel relation to the front wall 12 and the rear wall 14, and a slanted portion 18*b* which extends from the upper extremity of the vertical portion 18*a* to the front wall 12 and which has a plurality of openings 18*c*, for reasons to be described later. The partition 18 defines a first chamber 20 extending between the front wall 12 and the partition 18, and a second chamber 22 extending between the partition and the rear wall 14**.

A bed of particulate material, shown in general by the reference numeral 24, is disposed within the chamber 22 and rests on a perforated grate 26 extending horizontally in the lower portion of the boiler and defining the lower extremities of both chambers 20 and 22. The bed of particulate material 24 can consist of a mixture of discrete particles of inert material, and a fossil fuel material such as bituminous coal. The lower extremity of the vertical portion **18*a* of the partition 18 can terminate slightly above the grate 26 to form a through passage 28 that permits transfer of material from the chamber 20 to the chamber 22, as will be described in detail later. Alternatively, holes can be provided in the lower portion of partition 18** for the same effect.

Two air plenum chambers 30 and 32 are disposed immediately underneath the chambers 20 and 22 respectively and are provided with air inlets 34 and 36, respectively, for distributing air from an external source to the chambers. It is understood that air dampers or the like (not shown) may be provided in association with the inlets 34 and 36 or the chambers 30 and 32 for controlling the flow of air into and through the latter chambers.

A bed light-off burner 37 or the like could be mounted through the rear wall 14 or the front wall 12 immediately above the grate for initially lighting off the bed 20 or bed 24 during start up.

An inlet pipe 38 is provided through the front wall 12 in communication with the chamber 20 for introducing into the chamber an acceptor, such as raw limestone, for the sulfur produced by the fossil fuel during the combustion process. This acceptor would be in the form of a particulate material which falls into the chamber 20 and accumulates to a preselected height, such as the one shown in FIG. 1, in the chamber 20.

A gas inlet pipe 40 extends through the wall 12 into the chamber 20 for passing a high temperature gas, a combustible gas, or carbon dioxide rich flue gas into the chamber 20. The pipe 40 can also be connected to an exhaust fan or the like for removing gases from the chambers 20 and 22 as will be described in detail later. An air inlet pipe 44 also extends through the front wall 12 in communication with the lower portion of the chamber 20 and is adapted to receive pressurized air from an external source (not shown) and discharge same toward the passage 28 to assist the movement of the acceptor from the chamber 20 to the chamber 22.

An inlet 46 is provided through the side wall 16 (and the other side wall, as necessary) for introducing the particulate fuel material into the chamber 22 where it falls upon the upper surface of the bed 24 to replace the fuel material consumed during the combustion process. A drain pipe 49 extends through the rear wall 14 in communication with the lower portion of the bed 24 for expelling spent fuel material from the bed.

In operation, air is introduced into the chamber 32 via the air inlet 36 whereby it passes upwardly through the grate 26 and the bed 24 of fluidized material in the chamber 22 before it exits through a suitable outlet provided in the top of the boiler. This loosens the particulate material in the bed 24 and fluidizes it. The light-off burner 37 is then fired to heat the material in the bed 24 until the bed reaches a predetermined elevated temperature after which particulate fuel material is introduced into the chamber 22 and the bed 24 via the inlet 46. Upon establishing good combustion the burner 37 can be turned off.

As soon as the bed reaches its normal operational temperature, such as approximately 1550° F., the raw limestone is introduced into the chamber 20 via the inlet 38 where it accumulates in the latter chamber. The elevated temperature in the chamber 22 also raises the temperature of the limestone in the chamber 20. A gas, which could be a high temperature gas, a combustible gas, or carbon dioxide-rich flue gas, or the like, is introduced into the chamber 20 as needed via the inlet pipe 40. As a result, a partial pressure of carbon dioxide is maintained in the chamber 20 that is optimum for the calcining operation, and any excess gas, including carbon dioxide, discharges through the openings 18*c* formed in the partition 18. The air assist pipe 44 is activated to distribute the calcined limestone through the passage 28 into the lower portion of the chamber 22, it being understood that air can be introduced into the chamber 20 via the inlet 34 as needed to fluidize the limestone in the latter chamber and thus assist the movement of the limestone into the chamber 22. The limestone from the chamber 20 integrates with the bed material in the chamber 22 and accepts the sulfur produced as a result of the combustion of the fossil fuel. Alternatively, the pipes 40 or 34 could be connected to an exhaust fan and high temperature flue gases of increased carbon dioxide content can be gradually drawn from the chamber 22 through the openings 18*c* in the partition 18 and evacuated through the pipe 40, or through the grid 30 and pipe 34.

In the event that the heat from the fluidized bed 24 is not sufficient to calcine the limestone in the chamber 20, particles of fuel, such as bituminous coal, can be introduced into the chamber with the limestone through the inlet 40. This fuel would be ignited in the manner described above and air would be introduced, via the inlet 34, into the air plenum chamber 30 where it passes upwardly through the chamber 20 to fluidize the bed, promote combustion of the fuel and thus raise the temperature in the chamber 20 sufficiently to calcine the limestone.

It is thus seen that the embodiment of FIG. 1 provides a highly efficient calcination of the raw limestone in an area separate from the fluidized bed followed by an integration of the calcined lime into the bed. Alternatively this calcining bed can be located external and adjacent to the main bed housing 14.

Figure 2:
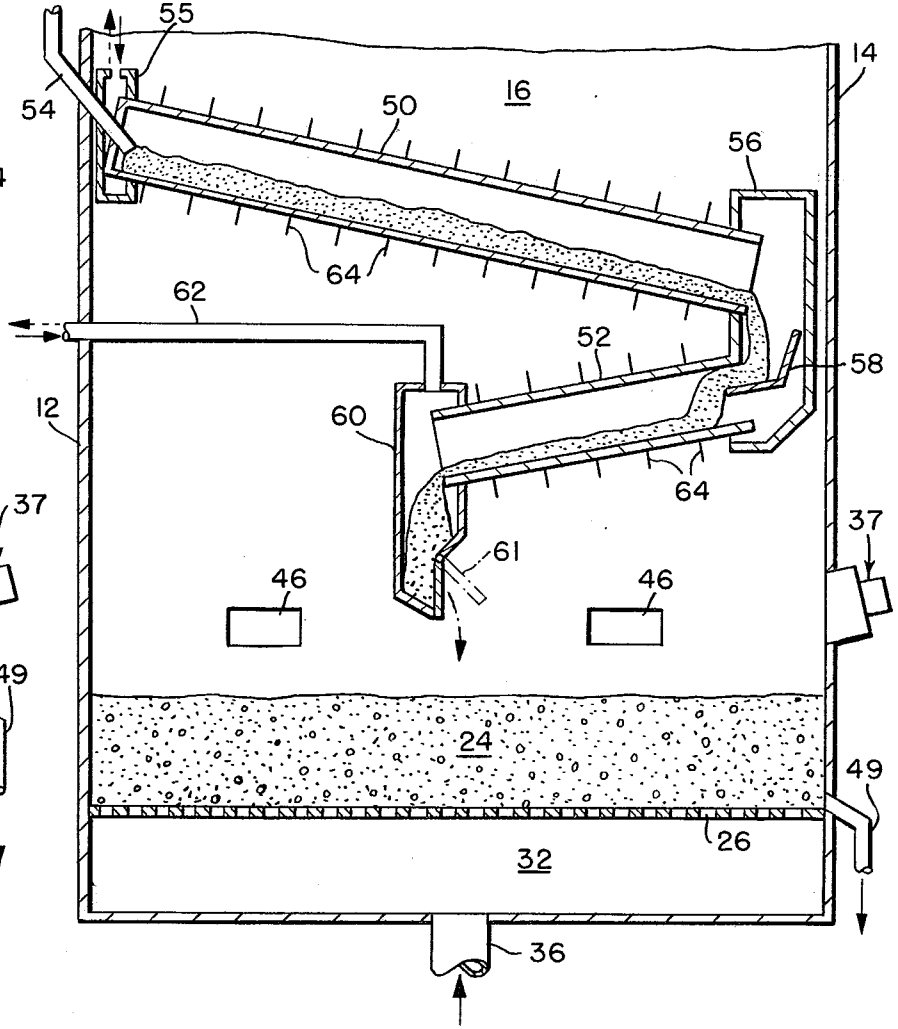
Figure 3:
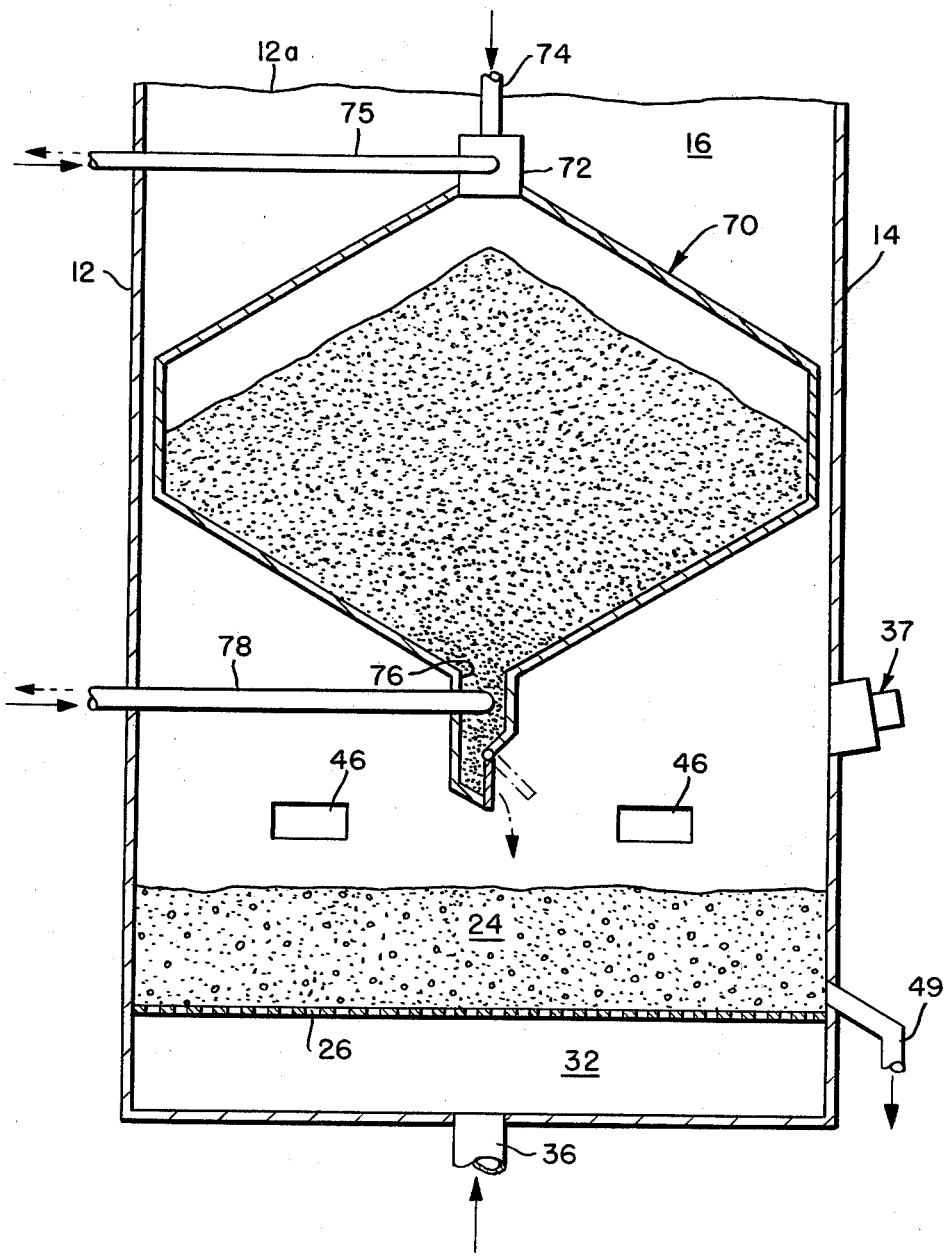

The embodiments of FIGS. 2 and 3 involve different techniques of calcination of the limestone and, to the extent that they involve identical structure as the embodiment of FIG. 1, the same reference numerals are used.

Referring specifically to FIG. 2, a single fluidized bed 24 of particulate inert material and fossil fuel material are disposed over a grate 26 which is disposed immediately above a single air plenum chamber 32 receiving air from an inlet 36. A pair of inlets 46 for particulate fuel material are provided in the side wall 16, it being understood that other inlets can be provided on the other side wall as needed.

According to this embodiment, a feeding system for the raw limestone to be calcined is provided in the freeboard space above the bed 24 and includes a pair of conveying and heating units 50 and 52 in the form of conduits. The unit 50 extends angularly downwardly from the front wall 12 to the rear wall 14 and the unit 52 is located below the unit 50, is slanted downwardly from the rear wall to the front wall and terminates in an area approximately midway between the latter walls. An inlet pipe 54 extends from an external source (not shown) of limestone, through the wall 12 and registers with the unit 50 to introduce the limestone into the latter unit. A distributor box 55 extends over the end of the unit 50 to provide for the passage of carbon dioxide-rich gases to or from the unit.

Due to the slanted arrangement of the unit 50, the limestone could flow from its upper end to its lower end by gravity or, alternatively, the units could be in the form of pipes or trays which could be rotated or vibrated, respectively, by external drives (not shown) to promote flow. In all cases heat is transferred from gas space 20 to the units 50 and 52 to support the endothermic calcining reaction taking place.

A support box 56 receives the lower end of the unit 50 as well as the upper end of the unit 52 and includes a baffle 58 which directs the limestone discharging from the unit 50 to the unit 52. The limestone thus flows down the unit 52 before discharging into an outlet box 60 which communicates with the discharge end of the unit 52. The outlet box 60 receives the calcined limestone from the unit 52 and has an isolated lower end including a pivoted plate 61 that permits the limestone to discharge onto the upper surface of the fluidized bed 24. A pipe 62 is provided in communication with the outlet box 60 and functions in the same manner as the pipe 40 of the previous embodiment, it being understood that a pipe could be associated with the distributor box 55 and perform the same function.

A plurality of heat transfer fins 64 are provided on the external surfaces of the units 50 and 52 to aid in the transfer of the heat from the fluidized bed 24 to the limestone in the units.

According to the operation of the embodiment of FIG. 2, raw limestone is introduced into the unit 50 via the inlet pipe 54 where it cascades downwardly through the units 50 and 52 before discharging from the distributor box 60. The size of the units 50 and 52 are selected and the flow rate of limestone flow through the units is regulated, so that an adequate residence time of the limestone in the units is established to pick up sufficient heat from the fluidized bed 24. This, plus the passage of gas into or from the distributor box 55 and the outlet box 60 ensures optimum calcination of the limestone by the time it discharges from the distributor.

According to the embodiment of FIG. 3, a subenclosure, or chest, 70 is provided in the freeboard space above the fluidized bed 24. The chest 70 includes a distributor box 72 which receives raw limestone from an inlet pipe 74 extending through the top (not shown) of the chest and connected to an external source (not shown) of limestone. A pipe 75 extends through the front wall 12 and communicates with the distributor box 72 for the passage of gases to and from the box as discussed in the previous embodiments. The lower portion of the chest 70 is funnel-shaped and has an outlet box 76 for discharging the limestone into the upper surface of the fluidized bed 24. A pipe 78 extends in communication with the outlet box 76 for passing gases into and from the outlet in the same manner as the pipe 40 of the first embodiment.

The chest 70 occupies a substantial area in the freeboard space above the fluidized bed, it being understood that the depth of the chest 70 in the plane of the drawing is less than the corresponding distance between the sidewalls 16. The flow rate of raw limestone through the chest 70 is regulated so that the limestone will accumulate in the chest as shown before discharging from the outlet 76 to ensure an adequate residence time of the limestone in a heat exchange relation with the heat from the fluidized bed 24. This plus the regulation of the gases passing into and from the distributor box 72 and the outlet box 76 enables optimum calcining conditions to be maintained. As a result, the limestone discharged from the outlet box 76 is calcinated in order to achieve a maximum acceptance of the sulfur formed during the combustion of the fossil fuel particles in the fluidized bed.

Therefore, it is apparent that the embodiments of FIGS. 2 and 3 enjoy the efficiency discussed above in connection with FIG. 1 while also enabling the calcination steps to be achieved at a relatively low cost.

It is understood that variations may be made in the foregoing without departing from the scope of the invention. For example, in the embodiment of FIG. 1, the chamber 20 can be located externally of the housing yet adjacent to the chamber 20. Also, heat exchange tubes can be provided in the boiler of the present invention for the purpose of passing water in a heat exchange relationship with the fluidized bed to add heat to the water. Further, although raw limestone has been mentioned throughout the specification as the preferred form of acceptor, it is understood that other materials, such as dolomite, or the like, that contain limestone can be utilized as the acceptor without departing from the scope of the invention. Also, catalysts, such as surface salts or the like, can be added to the acceptor to promote the sulfur capture by the acceptor.

A latitude of modification, change and substitution is intended in the foreoging disclosure and in some instances some features of the invention will be employed without a corresponding use of other features. Accordingly, it is appropriate that the appended claims be construed broadly and in a manner consistent with the spirit and scope of the invention herein.

What is claimed is:

1. A fluidized bed boiler comprising a housing, grate means supported in said housing and adapted to receive a bed of particulate material at least a portion of which is fossil fuel, means for passing air through said grate means and said particulate material to fluidize said particulate material, first means for introducing into said housing a raw acceptor for the sulfur produced as a result of combustion of said fuel, means for confining a supply of said acceptor within an area that is isolated from said bed of particulate material and in a heat transfer relation to the heat generated by said fluidized bed to calcine said acceptor, and second means for introducing said calcined acceptor into said bed, said second introducing means including means directing pressurized gas from the area within the confining means to the bed of particulate material to assist in moving the acceptor from said area to said bed.

2. The boiler of claim 1 wherein said acceptor is limestone.

3. The boiler of claim 2 wherein said limestone is converted to lime as a result of said calcining.

4. The boiler of claim 1 wherein said area is in a juxtapositioned relationship to said fluidized bed.

5. The boiler of claim 1 or 4 further comprising means for passing air through said area to fluidize the acceptor in said area to promote the introduction of said acceptor into said bed.

6. The boiler of claim 1 or 4 further comprising means for adding fuel material to said area to add additional heat to said area.

7. The boiler of claim 6 further comprising means for passing air through said area to promote the combustion of said fuel material in said area.

8. The boiler of claim 7 further comprising means for removing any excess carbon dioxide-rich gas from said area.

9. A fluidized bed boiler comprising a housing, grate means supported in said housing and adapted to receive a bed of particulate material at least a portion of which is fossil fuel, means for passing air through said grate means and said particulate material to fluidize said particulate material, means for introducing into said housing a raw acceptor for the sulfur produced as a result of combustion of said fuel, means for confining said acceptor within an area that is isolated from said bed of particulate material and in a heat transfer relation to the heat generated by said fluidized bed to calcine said acceptor and for introducing said calcined acceptor into said bed, said confining and introducing means comprising at least one downwardly slanted, elongated distribution conduit positioned in a vertically stacked configuration within said housing above said fluidized bed, wherein said means for introducing said raw acceptor into said housing deposits said raw acceptor into the upper end of the uppermost of said at least one downwardly slanted distribution conduit and wherein the calcined acceptor passes from the lower end of the lowermost of said slanted elongated conduits onto said bed of particulate material.

10. The boiler of claim 1 or 9 further comprising means for introducing carbon dioxide rich gas to said area to promote the calcining of said acceptor.

11. The boiler of claim 10 wherein said carbon dioxide-rich gas introducing means comprises a pipe communicating with said area and connected to a source of said carbon dioxide-rich gas.

12. The boiler of claim 10 wherein said carbon dioxide-rich gas introducing means comprises a pipe communicating with said area and connected to an exhaust fan for drawing said gas from a zone above said fluidized bed to said area.

13. The boiler of claim 9 wherein there are two or more distribution conduits disposed in a heat exchange relationship with said bed, one of said conduits being adapted to receive said acceptor and discharge the acceptor to the other conduit, said other conduit being adapted to discharge the acceptor to the fluidized bed.

14. The boiler of claim 13 wherein said other distribution conduit is disposed underneath said one distribution conduit so that said acceptor cascades down said conduits before discharging into said fluidized bed.

15. The boiler of claim 13 wherein the size of said distribution conduits and the flow rate of said acceptor through said conduits are selected so that the residence time of said acceptor within said conduits is sufficient to enable said acceptor to receive sufficient heat from said bed to calcine said acceptor.

* * * * *